United States Patent [19]

Bärnthaler et al.

[11] Patent Number: 4,711,502

[45] Date of Patent: Dec. 8, 1987

[54] APPARATUS FOR CUTTING EXCAVATIONS HAVING A SUBSTANTIALLY PLANAR FACE

[75] Inventors: Franz Bärnthaler, Weisskirchen; Ferdinand Bedenk, Zeltweg; Otto Schetina, Zeltweg; Alfred Zitz, Zeltweg, all of Austria

[73] Assignee: Voest-Alpine Aktiengesellschaft, Linz, Austria

[21] Appl. No.: 754,214

[22] Filed: Jul. 12, 1985

[30] Foreign Application Priority Data

Jul. 16, 1984 [AT] Austria ..... 2300/84

[51] Int. Cl.[4] ..... E21C 27/18; E21P 23/03

[52] U.S. Cl. ..... 299/33; 299/12; 299/75

[58] Field of Search ..... 299/33, 42, 43, 54, 299/75, 76, 78, 55, 56, 12

[56] References Cited

U.S. PATENT DOCUMENTS

| | | | |
|---|---|---|---|
| 2,619,339 | 11/1952 | Cartlidge | 299/75 |
| 3,640,580 | 2/1972 | White | 299/12 X |
| 3,954,299 | 5/1976 | Hartley | 299/54 X |
| 4,160,619 | 7/1979 | Nelson | 414/501 |
| 4,199,193 | 4/1980 | Damron et al. | 299/33 X |
| 4,589,701 | 5/1986 | Beckmann et al. | 299/75 X |

FOREIGN PATENT DOCUMENTS

| | | | |
|---|---|---|---|
| 371902 | 8/1983 | Austria . | |
| 2633544 | 2/1977 | Fed. Rep. of Germany | 299/54 |
| 1403821 | 8/1975 | United Kingdom | 299/43 |
| 1539534 | 1/1979 | United Kingdom | 299/43 |
| 2075092 | 11/1981 | United Kingdom | 299/33 |
| 2142678 | 1/1985 | United Kingdom | 299/56 |

*Primary Examiner*—Stephen J. Novosad
*Assistant Examiner*—David J. Bagnell
*Attorney, Agent, or Firm*—Cushman, Darby & Cushman

[57] ABSTRACT

An apparatus for cutting excavations having a substantially planar face comprises a cutting tool which is rotatably mounted on a jib. The jib is mounted on a mobile machine for a pivotal movement in a plane which is transverse to the heading direction and is divided into two jib sections which are pivotally movable relative to each other about an axis which is substantially parallel to the pivotal axis of the jib. The cutting tool is rotatably mounted close to or at the free end of that jib section which is most remote from the pivotal axis of the jib.

4 Claims, 3 Drawing Figures

APPARATUS FOR CUTTING EXCAVATIONS HAVING A SUBSTANTIALLY PLANAR FACE

BACKGROUND OF THE INVENTION

1. Field of the Invention

This invention relates to an apparatus for cutting excavations having a substantially planar face. The apparatus comprises a cutting tool rotatably mounted on a jib, which is pivoted to a mobile machine.

2. Description of the Prior Art

In conventional cutting machines, the jib or cutter arm is pivoted on a chassis for rotation about a substantially vertical axis and about a substantially horizontal axis. The jib must be long enough to permit the making of excavations having a relatively large cross-sectional area but the pivotal movement of such jib in a lateral or vertical direction will result in the formation of a substantially curved face. If the roof tends to cave in, the road must be provided with temporary supports close to the working face in order to prevent the roof from breaking down. The placing of such temporary supports is relatively expensive and time-consuming and the temporary supports cannot be placed as close as possible to the working face because the cutter arm or jib is pivotally movable also in a lateral direction. Besides, the use of such temporary supports gives rise to a need for expensive means by which the supporting frames and auxiliary means required for the placing of the supports can be moved over the cutting machines disposed at the working face, and the space close to the working face is relatively confined. In the use of the known apparatus, the cutting work must be interrupted for the placing of supports close to the working face because it is not possible to provide a reliable guard at locations disposed between the cutting tools and close to the working face as such guards would be struck by the cutter arm.

SUMMARY OF THE INVENTION

It is an object of the invention to provide an apparatus which is of the kind described hereinbefore and which has a very small overall length in the heading direction and permits a reliable separation of the working face from the road so that supports can be placed in the road even close to the working face without a need for an interruption of the cutting work and without endangering or impairing the workers. This object is accomplished in accordance with the invention by the provision apparatus in which the jib is mounted for a pivotal movement in a plane which is transverse to the heading direction. The jib is divided into at least two jib sections, which are pivotally movable relative to each other about an axis which is substantially parallel to the pivotal axis of the jib, and the cutting tool is rotatably mounted close to or at the free end of that jib section which is most remote from the pivotal axis of the jib. Because the jib is mounted for a pivotal movement in a plane which is transverse to the heading direction, only a very small space in the heading direction is required for a movement throughout the height and width of the desired excavation. Because the jib is divided into at least two jib sections, which are pivotally movable relative to each other, a large surface, e.g., the entire working face, can be acted upon by the cutting tool of an apparatus having a small overall length in the heading direction. The cutting tool is rotatably mounted close to or at the free end of that jib section which is most remote from the pivotal axis of the jib arm. In a particularly simple embodiment the jib arm may be pivoted on an axis which is parallel to the heading direction and the drive means for imparting such pivotal movement may be substantially centrally disposed within the cross-sectional area which is to be excavated.

In a preferred embodiment the cutting tool consists of a cutter drum or cutter head, which is mounted for rotation about an axis which is parallel to the pivotal axis of the jib. Such cutter drums or cutter heads may be used for an economical cutting on relatively large surfaces and have such dimensions that the drive means can be accommodated inside the hollow cutter drum or cutter head so that the overall dimensions can be further reduced.

In order to facilitate the initial cutting into the working face for an excavation, the design is preferably such that at least one of the jib sections, preferably the outermost jib section, is adapted to be angled in itself about an axis which crosses or intersects the pivotal axis on which said jib section is pivoted to the next preceding jib section or the pivotal axis provided at the drive means for imparting the pivotal movement. In such an embodiment the initial cutting into the working face can be performed more easily in that the end of the outermost jib section is pivotally moved toward the working face when the machine or the chassis of the machine is in a selected position and the cutting work can subsequently be performed throughout the area of the excavation when the entire apparatus has been advanced toward the working face.

As has been mentioned hereinbefore the important advantage afforded by the short length in the heading direction resides in that the roof can be supported even close to the working face. The material which has been cut off is to be carried away in a reliable manner. In a particularly simple arrangement the drive means for pivotally moving the jib are mounted or supported on a bracket, which is supported relative to the mobile machine and relative to the floor and preferably consists of a part of a loader or conveyor, which part is supported on the floor, whereas the drive means for rotating the cutting tool are provided on the outermost jib section and preferably at least in part inside the hollow cutting tool. Because the drive means for rotating the cutting tool are provided on the outermost jib section and preferably at least partly inside the hollow cutting tool, the kinematics of the means for adjusting the jib are not affected by forces exerted by the drive means for rotating the cutting tool and the angle between the jib sections can be adjusted in a simple manner about suitable pivotal axes by cylinder-piston units. If such a bracket is provided as a support for the drive means for imparting a pivotal movement to the jib, said bracket can remain in a predetermined position during the cutting work performed over the area of the excavation so that said bracket can be used to support a device for drilling roof holes or for setting bolts dust-tight shield or wall extending preferably in the cross-sectional plane in which the bracket and the drive means for imparting a pivotal movement are disposed is supported by the bracket and has external edges consisting of flexible sealing means. Such a shield may consist, e.g., of a wall made of a material which has a limited flexibility and may extend over the free cross-section of the road. Such a shield or wall will protect the workers not only from dust but also from pieces of rock thrown off by the cutting tool.

Because the cutting apparatus has small overall dimensions in the heading direction, the provision of such shield will permit a placing of permanent supports in a protected space extending close to the working face, usually to a distance of about 1.5 meters from the working face, so that the expensive means otherwise required for placing temporary supports are no longer necessary. As the bracket and the drive means for imparting a pivotal movement remain substantially in a given position during an excavating sweep across the working face, such wall or shield will ensure a tight separation so that components having a sufficiently high stability, such as sheet metal elements, may be used as such wall or shield. Only the outer edges should be flexible in order to ensure a dust-tight contact with the roof or the side walls of the road. As a rule, it will be sufficient if that flexible portion has a width not in excess of 500 millimeters so that the risk of damage by rock caving in appears to be eliminated. The dust-tight sealing means are disposed between the jib and the device for drilling roof holes and for setting bolts so that all said means, which are combined in a reliable heading machine, can be mounted on the same bracket or the same component and can be supported by substantially vertical props against the roof, the loader, the conveyor and/or the floor.

For a reliable discharge of the material which has been cut off, the loader is desirably disposed in the projection of the jib onto the floor plane and is constituted by a loading ramp, which extends transversely to the heading direction. Such a loader may have small dimension in the heading direction and the entire rock falling on the floor will be received by the loader.

In order to ensure that the apparatus in accordance with the invention has a high maneuverability and can be used also to cut in roads which deviate from a straight line, the undercarriage of the mobile machine is spaced behind the mechanism for turning the jib and permits a pivotal movement of that turning mechanism relative to those parts of the conveyor which continue to extend along the longitudinal axis. For instance, a conventional undercarriage, may be used, and the forward part of the conveyor may be pivoted to said undercarriage for a pivotal movement about a substantially vertical axis. Alternatively, a movement may be imparted to the forward portion of the conveyor and to the undercarriage so that they extend at an angle to a rear part of the conveyor, which continues to extend in the longitudinal direction of the road. As a result, the turning mechanism and the pivotal axis of the jib will assume an oblique orientation relative to the original heading direction or the axis of the road and an excavation for a bend may be initiated.

The invention will now be explained more fully with reference to an illustrative embodiment shown on the drawing.

DETAILED DESCRIPTION OF THE DRAWING

Figure 1:
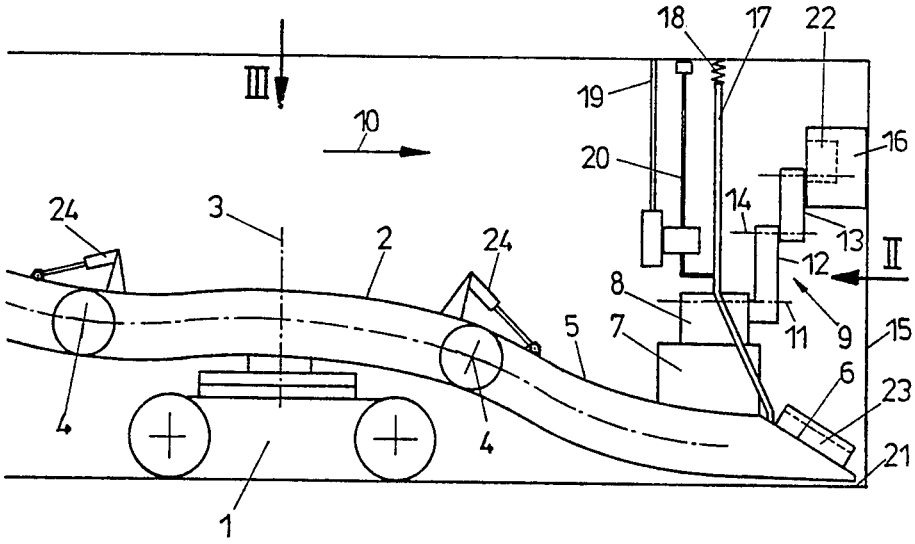
FIG. 1 is a diagrammatic side elevational view showing an apparatus in accordance with the invention.

FIG. 1 shows a machine having a tractor undercarriage 1 and a conveyor 2, which is pivoted to the undercarriage 1 on a substantially vertical axis 3. The conveyor 2 is divided into a plurality of sections, which are pivotally interconnected on substantially horizontal axes 4. The forward section 5 merges into a loading ramp 6. A bracket 7 is secured to the loading ramp 6 and/or the forward section 5 of the conveyor 2 and carries a turning mechanism 8 for a jib 9. The heading direction of the machine is indicated by the arrow 10. The pivotal axis 11 of the jib 9 extends substantially parallel to the heading direction (arrow 10).

The jib 9 is divided into two sections 12 and 13, which are pivotally connected on an axis 14. The jib 19 is pivotally movable substantially parallel to the working face 15. The two sections 12 and 13 of the jib 9 are pivotally movable relative to each other in the same plane, which is parallel to the working face 15 and at right angles to the pivotal axis 11 because the axis 14 is parallel to the pivotal axis 11. The outer jib section 13 carries at its free end a cutting tool, which consists of a cutter drum 16.

The bracket 7 also supports a wall 17, which seals the working face 15 and extends around the turning mechanism 8 and tightly engages the loading ramp 6. That sealing wall 17 is provided at its outside periphery with a flexible portion 18, which serves as a sealing element. A device 19 for drilling roofholes and for setting bolts is disposed behind that sealing wall 17. The bracket 7 and the means carried by the bracket 7 as well as the loading ramp 6 can be engaged by props 20, which are forced against the roof so that the loading ramp 6 is forced against the floor 21.

The cutter drum 16 has an internal cavity, which contains a diagrammatically indicated drive unit 22. Conveyor means 23 are slidably mounted on the loading ramp 6. The bracket 7 as well as the means carried by the bracket 7 and the conveyor means 23 can be moved in the heading direction by the undercarriage 1 and can be pivotally moved in or parallel to the plane of the floor 21 about the vertical axis 3. Besides, the parts of the conveyor 2 can be raised and lowered by hydraulic cylinder piston units 24.

Figure 2:
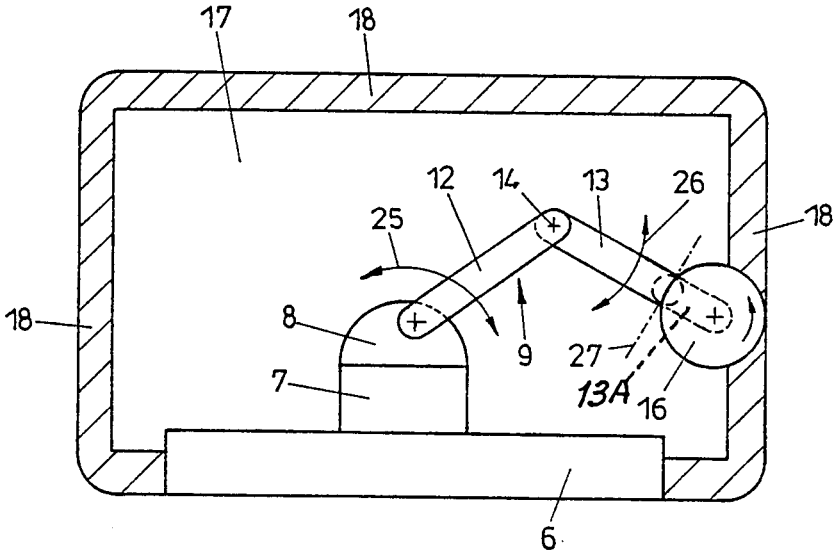
FIG. 2 is a diagrammatic front elevational view showing the apparatus of FIG. 1 viewed in the direction of the arrow II in FIG. 1.

From the arrangement shown in FIG. 2 the kinematic arrangement for turning the jib 9 is clearly apparent. The first jib section 12 is directly connected to the turning mechanism 8 and pivotally movable in the direction of the double-headed arrow 25. The second jib section 13 is pivotally movable relative to the first jib section 12 about the axis 14 in the directions indicated by the double-headed arrow 26. The entire pivotal movement is performed in a plane which is parallel to the working face 15, which is shown in FIG. 1. The cutter head or the cutter 16 protrudes at least in part beyond the forward end of the second jib section 13 so that an exact cutting to form the side walls and the roof is also ensured. In order to facilitate the initial penetration, the outer jib section 13 may be divided in itself and, e.g., its end portion 13A may be pivotally movable relative to the longitudinal axis of the jib section 13 about a pivotal axis diagrammatically indicated at 27.

Figure 3:
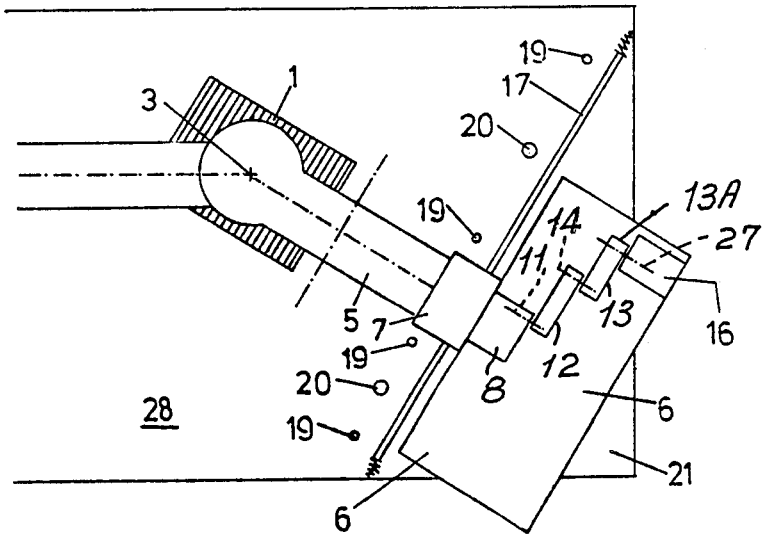
FIG. 3 is a top plan view showing the apparatus shown in FIG. 1 viewed in the direction of the arrow III in FIG. 1.

FIG. 3 illustrates how the apparatus in accordance with the invention may be used to drive roads which deviate from a straight line. The road 28 and the tractor undercarriage 1 is shown in a position to which it has been pivotally moved out of the axis which is parallel to the longitudinal axis of the road 28. Such slewing movement about the substantially vertical axis 3 is imparted also to the forward section 5 of the conveyor 2 as well as to the loading ramp 6 and the bracket 7 supported on said forward section 5. In that position the diagrammatically indicated first excavating sweep for the bend is made and the material excavated by the cutter head 16 is received by the loader or loading ramp 6 disposed under the cutter head 16 in the projection on the floor 21. Immediately behind the sealing element or wall 17, the placing of permanent supports by means of the roofhole drilling and bolt setting device 19 can be initiated. Even when the apparatus is excavating a bend, props 20 can be fixed between the roof and the floor 21. These props 20 are carried along and supported on the bracket 7.

We claim:

1. Apparatus for cutting excavations having a substantially planar face (15), comprising a cutting tool (16), which is rotatably mounted on the jib (9), which is pivoted to a mobile machine, characterized in that the jib (9) is mounted for a pivotal movement in a plane which is transverse to the heading direction (10), the jib (9) is divided into at least two jib sections (12, 13), which are pivotally movable relative to each other about an axis (14) which is substantially parallel to a pivotal axis (11) of the jib (9), said jib being pivotable about said pivoted axis (11) and the cutting tool (16) is rotatably mounted close to or at the free end of that jib section (13) which is most remote from the pivotal axis (11) of the jib (9), characterized further in that the jib (9) is pivotally movable about the pivotal axis (11), which is parallel to the heading direction (10), characterized still further in that the cutting tool (16) includes a cutter drum or cutter head, which is mounted for rotation about an axis that is parallel to the pivotal axis (11) of the jib (9), characterized in that at least one of the jib sections (12, 13), preferably the outermost jib section (13), is adapted to be angled in itself at an end portion (13A) about an axis (27) which is perpendicular to but spaced from the axis (14) on which said outermost jib section (13) is pivoted, said preceding jib section (12) being pivotable on the pivotal axis (11), said jib (9) being provided on a turning drive (8), further comprising a loader (6) and conveyor (2, 5) and further characterized in that the turning drive (8) for the jib (9) is mounted or supported on a bracket (7), which is supported by the mobile machine on a part of the conveyor (2, 5), which part is supported on the floor and the drive means (22) for rotating the cutting tool (16) are mounted on the outermost jib section (13) and preferably at least in part inside cutting tool (16), said cutting tool being hollow, characterized in that at least one roofhole drilling and bolt setting device (19) is supported on the bracket (7) which carries the jib (9), characterized in that a dust-tight shield or wall (17) succeeding the jib (9) in the heading direction (10) is supported on the bracket (7) and has external edges (18) with flexible means for sealing the working face (15), and characterized in that the loader (6) is disposed under the jib (9) and includes a loading ramp (6) which extends transversely to the heading direction.

2. Apparatus according to claim 1, characterized in that the dust-tight sealing means (17, 18) are disposed between the roofhole drilling and bolt setting device (19) and the jib (9).

3. Apparatus according to claim 1, characterized in that the dust-tight sealing means (17, 18) consist of a shield and are supported by substantially vertical props (20) against the roof, the loader (6), the conveyor (2, 5) and/or the floor (21).

4. Apparatus according to claim 1 characterized in that an undercarriage (1) of said mobile machine supports said machine underneath conveyor (2) and is spaced behind said drive mechanism (8).

* * * * *